United States Patent [19]

Babish et al.

[11] 4,083,399

[45] Apr. 11, 1978

[54] VALVING FOR ENGINE COOLING SYSTEM FLUSHING APPARATUS AND METHOD

[75] Inventors: John A. Babish, Glendora; Larry K. Arnot, Duarte; Douglas C. Appel, Glendora, all of Calif.

[73] Assignee: Wynn Oil Company, Fullerton, Calif.

[21] Appl. No.: 815,495

[22] Filed: Jul. 14, 1977

Related U.S. Application Data

[63] Continuation-in-part of Ser. No. 741,065, Nov. 11, 1976, abandoned.

[51] Int. Cl.[2] ..... F28G 9/00

[52] U.S. Cl. ..... 165/95; 123/41.14; 134/56 R; 134/98; 134/102; 134/103; 134/169 A; 134/171

[58] Field of Search ..... 165/95, 1; 134/166 R, 134/22 R, 169 R, 169 A, 96, 95, 98, 102, 103, 56 R; 123/41.14

[56] References Cited

U.S. PATENT DOCUMENTS

| | | | |
|---|---|---|---|
| 2,222,516 | 11/1940 | Powell et al. | 134/169 A X |
| 2,681,657 | 6/1954 | Griffith, Jr. | 134/98 |
| 3,115,145 | 12/1963 | Monteath, Jr. | 134/98 X |
| 3,409,218 | 11/1968 | Moyer | 165/95 X |

*Primary Examiner*—Albert W. Davis, Jr.
*Attorney, Agent, or Firm*—William W. Haefliger

[57] ABSTRACT

An internal combustion engine cooling system is flushed by:

a. providing a controlled pressurized flow of flushing liquid and entrained gas bubbles,
b. and passing said flow alternately through
   i. the radiator in a reverse direction,
   ii. the engine coolant passages in a reverse direction,
   iii. the radiator in a forward direction,
   iv. the engine coolant passages in a forward direction.

Flow distribution control valves have ports directly connected so that the valve selectors may have corresponding clock angle positions; also, short length plastic tubing may be used to connect the valve ports, and to connect to console ports.

21 Claims, 9 Drawing Figures

30
33a
45
AIR PRESSURE
44a
INCREASE
AIR REG.
46
C
OFF
AIR FLOW
31
36
36a
B
OFF
RADIATOR HOSE
28a
27
(VALVE 46)
FLUSH
DRAIN
INJECT
HEATER HOSE
21a
230
(VALVE 36)
(VALVE 56)
A
B
C
STEPS
WATER PUMP
23a
24
A
OFF
56a
FLOW INDICATOR
DRAIN
34a
WATER PRESSURE
56
65
SUPPLY
40
32a
31

4
5
6
210
212
211
56
231
57
225
59
56a
58
63
230
64

219a
210
219
220
214
211
56
218
225
~217~
227
228
215
56a
226
229
221
210a
63
230
64

75
77
71
30
~70~
72

210
241
222
221
212
210a
214
215
36
36a
50
51
52
216
54
55
204
202
202a
53
200
200a
203
240
60
62
61
205
56
57
59
58
63
64
211
219a
56a
230
231
242
228
7
217
219
217
210a
210

VALVING FOR ENGINE COOLING SYSTEM FLUSHING APPARATUS AND METHOD

BACKGROUND OF THE INVENTION

This application is a continuation-in-part of our prior application Ser. No. 741,065, filed Nov. 11, 1976, and now abandoned.

This invention relates generally to flushing of internal combustion engine liquid cooling systems; more particularly, it concerns an air pressure assisted flushing of such systems wherein air bubbles entrained in flushing liquid act to efficiently scavenge or scrub scale and rust from coolant passages.

Studies show that over-heating is a major cause of vehicle breakdowns on highways. Engine cooling systems must operate efficiently at all times to avoid costly repairs that result from excessive temperature. In this regard, cooling systems contaminated by rust, scale build-up and sludge cannot provide adequate heat transfer and cooling system efficiency; in addition, thermostats fail to open, hoses deteriorate, impellers bind or break-off, and engine blocks can become distorted or crack. Accordingly, there is a need for efficient engine cooling system flushing methods and apparatus; however, those with which we are familiar lack the unusually advantageous combinations of structure, modes of operation and results as are now afforded by the present invention.

SUMMARY OF THE INVENTION

It is a major object of the present invention to provide improved flushing apparatus characterized as overcoming the problems discussed above and the disadvantages of prior flushing techniques. Basically, the invention employs the combined forces of controlled pressurized water and air turbulence to effect efficient flushing and cleaning of internal combustion engine liquid cooling systems including both the horizontal and vertical flow radiators. The improved apparatus comprises:

a. first means to produce a pressurized flow of flushing liquid and entrained gas bubbles, b. a series of flow ports selectively connectible to different points in said system, utilizing appropriate adaptors, said ports including first, second and third ports, c. control means operable to direct said flow from said first means and via said ports in four separate modes, identified as follows:

i. through the radiator in a reverse direction, ii. through the engine coolant passages in a reverse direction, iii. through the radiator in a forward direction iv. through the engine coolant passages in a forward direction, d. said control means including a primary valve connected to receive said flow in the form of pressurized water and air bubbles, said valve having three outlets respectively connectible with said first, second and third ports, e. said series of flow ports including a drain port, and said control means including a secondary valve having three inlets respectively connectible with said first, second and third ports, said second valve having a discharge port connectible with the drain port, and f. the three outlets of the primary valve respectively directly communicating with the three inlets of the secondary valve via first, second and third ducts to which said first, second and third ports are respectively connectible.

In addition, the flow may pass reversely and forwardly through the water pump in modes (i) through (iv) and reversely and forwardly through both the water pump and heater in modes (ii) and (iv).

As will appear the ports typically include a first port selectively connectible to the radiator; a second port selectively connectible with the heater and engine coolant passages; and a third port is selectively connectible with the coolant pump, the pump and heater normally being included in the liquid coolant system. Further, the first, second and third ducts typically have outlets to which the first, second and third ports are connectible, as via plastic hoses to establish the flow in the four different modes as referred to, the contaminated flush water flowing to a drain port in each mode. Also, te three ducts may include parallel plastic hose sections, for simplicity, and to enable the primary and secondary valves to have the same basic construction. A single console may be provided to carry all of the elements, including the pressurized water and air inlet ports as well as a water and air pressure regulators and associated equipment.

A further feature of the invention concerns the provision of an air selector valve whose positions are correlated to those of the primary and secondary control valves, and a winter/summer coolant (anti-freeze) container, the valve having alternate positions in one of which air is supplied to mix with water for flushing purposes as described, one for draining the system to allow for anti-freeze addition if required, and in another position air is supplied to the anti-freeze liquid container to force such liquid into the cooling system, saving time.

These and other objects and advantages of the invention, as well as the details of an illustrative embodiment, will be more fully understood from the following description and drawings, in which:

DRAWING DESCRIPTION

FIG. 1 is a frontal elevation of flushing apparatus for an engine cooling system;

FIG. 1*b* is a diagram of an internal combustion engine cooling system;

DETAILED DESCRIPTION

The numbers as used herein correspond insofar as possible, with numbers used in parent application Ser. No. 741, 065.

Figure 1:
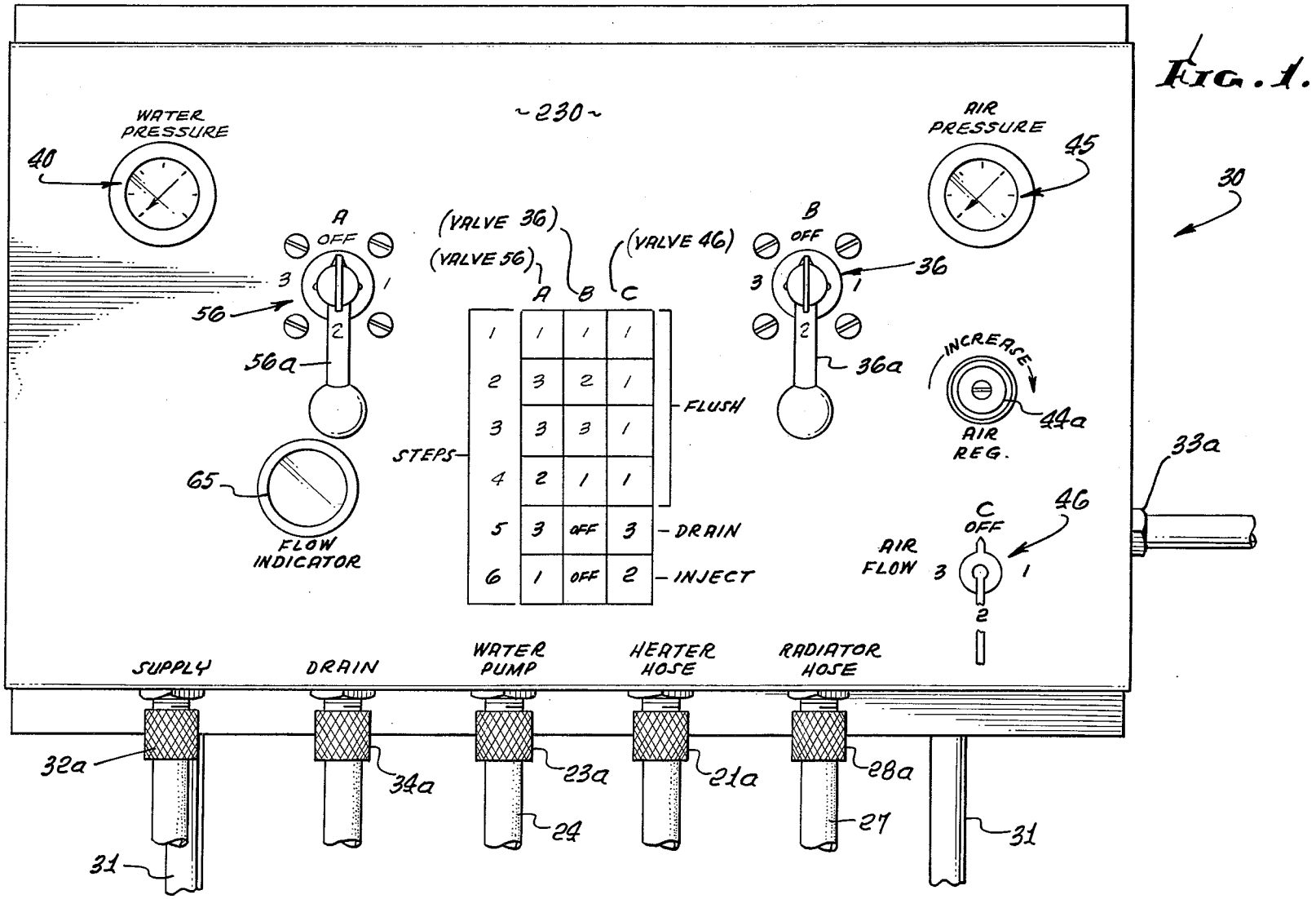
Figure 1B:
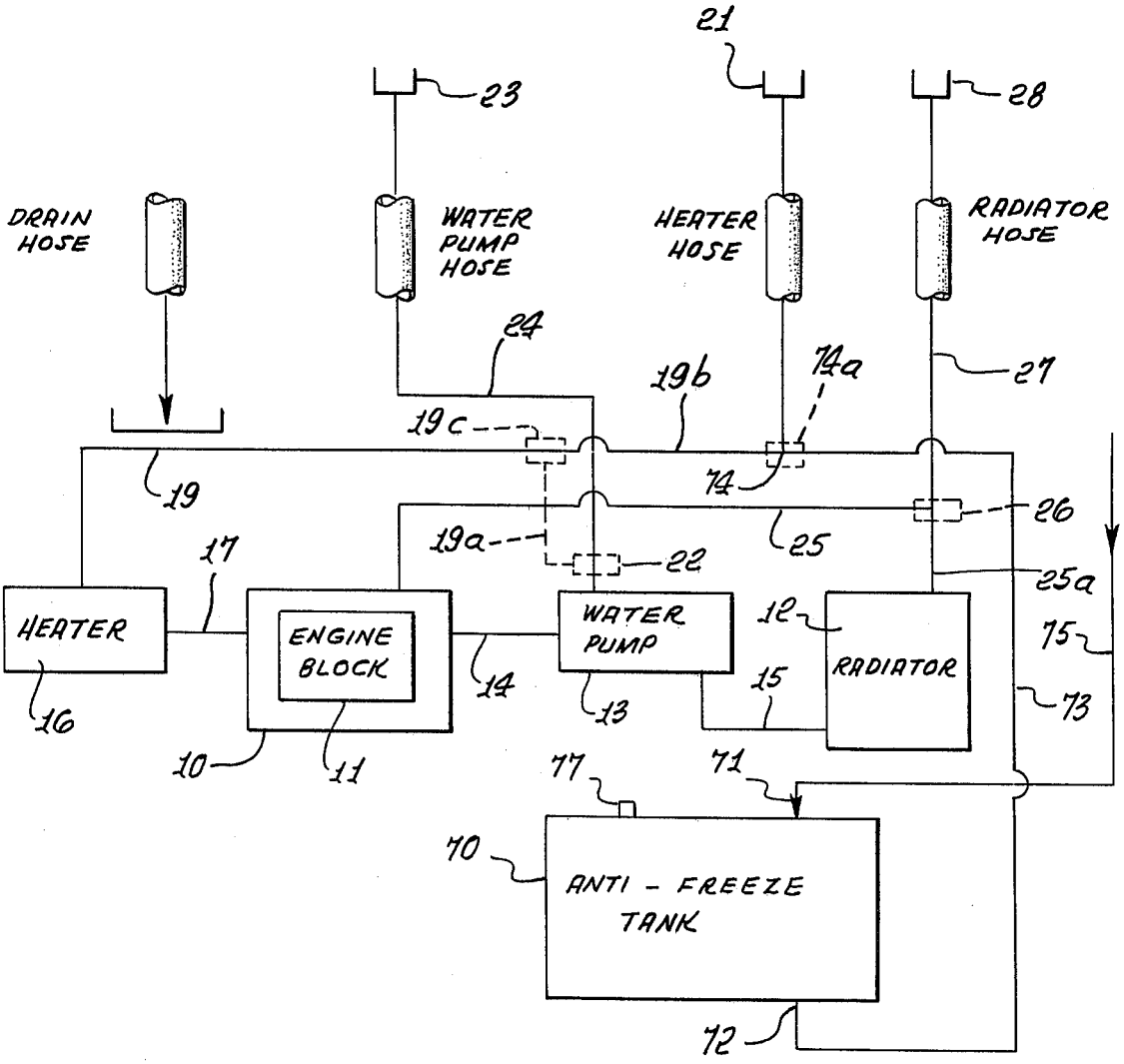

In FIG. 1*b* there are schematically shown an internal combustion engine 10 having a block 11 defining coolant passages through which liquid coolant (such as water) is adapted to pass; a radiator 12; and a coolant (i.e. water) pump 13 connected to pump coolant between the block and radiator, as via lines 14 and 15. Also shown is a heater 16 connected at 17 with the block 11 as for use in a vehicle to be heated. Normally, the water pump is connected with the heater via hoses 19 and 19*a*, however, the latter is shown as a broken line indicating that it is to be removed in accordance with the invention. The hose 19 is instead connected via coupling 19*c* with a hose 19*b* connected to a port 21 defined by the heater hose coupling 21*a* seen in FIG. 1. The water pump is then connected, (as for example at its intake) via adapter 22 and hose 24, with a port 23 defined by the water pump coupling 23*a* seen in FIG. 1. The connection to the water pump is typically at its intake side.

In addition, the upper radiator hose 25 is normally only connected with the engine block and radiator. A three-way adapter 26 is installed in hose 25 on horizontal flow radiators, and another hose 27 connected between the adapter and a port 28 defined as by the radiator hose coupling 28*a* seen in FIG. 1. Hose extension 25*a* connects between the adapter 26 and the top of the radiator at its upper end. On vertical flow radiators, adaptor 26 is installed in the radiator filler neck utilizing the adaptor modifiers provided and hose 27 connects between the adaptor and port 28, as will be later described. In that event, the hose 25 remains connected to the radiator upper interior.

First means is provided to produce a pressurized flow of flushing liquid (such as water) and gas bubbles (such as air bubbles), and second means is connected between the first means and the cooling system to controllably feed the flow to the system, whereby the scrubbing action of the collapsing and expanding gas bubbles and flushing liquid efficiently removes scale and rust from the system during successive flushing cycles. For example, control means is provided and is typically operable to direct such flow from the first means and via the ports, in four separate modes, identified as follows:

i. through the water pump and radiator in a reverse direction,
ii. through the heater, engine coolant passages and water pump in a reverse direction,
iii. through the radiator and water pump in a forward direction,
iv. through the water pump, engine coolant passages and heater in a forward direction.

Such modes ensure that rust and scale removed from either one of the radiator, heater or engine does not clog or remain in the other during flushing.

A console is typically provided as at 30 to carry the first means, ports and control means, and may be suitably supported as by legs 31 so that the console is at best working level relative to the engine and radiator, as on a vehicle. In addition to the first port (such as defined at 28 by coupling 28*a*) selectively connected to the radiator, the second port (such as defined at 21 by coupling 21*a*)selectively connected with the heater, and the third port (such as defined at 23 by coupling 23*a*). The console may also carry a fourth port 32 defined by coupling 32*a*, a fifth port defined by coupling 33*a*, and a drain port 34 defined by coupling 34*a*.

The first means to produce the pressurized flow of flushing liquid and entrained gas bubbles may be considered to include the water inlet port 32 (hose coupled at 32*a* to the console) the gas or air inlet port 33, and certain ducting. The latter is connected between such ports and an inlet port 35 defined by a primary valve 36. Such ducting is shown to include, for example, water supply ducts 37*a* and 37*d* with elements 38 and 39 connected in series therewith. Such elements include water pressure regulator 38 which is adjustable at 38*a* and an anti-back flow valve 39. A water pressure gage 40 is connected to the regulator via line 37*c* to indicate regulated pressure. The ducting also includes, for example, pressurized air supply ducts 41*a*–43*a* with elements 44 and 46 connected in series therewith. The latter elements include an air pressure regulator 44, adjustable at 44*a*, (see FIG. 1) and air selector valve 46. An air pressure gage 45 is connected at 45*a* to the regulator 44, to indicate regulated air pressure. With the valve 46 in the open flush position, number 1, air flows to mix at 48 with water, at the same adjustably regulated pressure, and flow at 49 to the inlet 35. One typical regulator 38 is Type E-41 produced by A.W. Cash Valve Mfg., Corp., Decatur, Ill. One typical regulator 44 is Type R04 produced by C.A. Norgren Co., Littleton, Colo.

The control means may be considered to include primary valve 36 (water inlet valve) which has three outlets 50, 51 and 52 respectively connected with the first, second and third ports 28, 23 and 21, as via lines 53–55. In addition, the control means may advantageously include a secondary valve 56 having three inlets 57–59 also respectively connected with the first, second and third ports, as via lines 60–62. Valve 56 also has a discharge port 63 connected via lines 64, flow indicator 65 and line 66 with drain port 34. Indicator 65 may include a sight glass, with a vaned rotor that is turned by the flow.

In accordance with an important aspect of the invention, the three outlets 50–52 of the primary valve 36 respectively directly communicate with the three inlets 57–59 of the secondary valve 56, via first, second and third ducts. For example, the first duct includes sections 53 and 60 plus a section 200*a* of tee 200; the second duct includes sections 55 and 62 plus a section 202*a* of a tee 202; and the third duct includes sections 54 and 61 plus a section 201*a* of a tee 201. Also, the first, second and third ducts are respectively connectible with first, second and third ports; for example, the side branch of tee 200 and hose 203 connect the first duct with a first port such as at 28 (the radiator connection); the side branch of tee 202 and hoses 204 and 204*a* connect the second duct with a second port such as at 21 (the heater hose connection); and the side branch of tee 201 and hose 205 connect the third duct with a third port such as at 23 (the water or coolant pump connection). The three ducts, as defined, and interconnecting the two valves 36 and 56 extend in generally parallel relation directly between the valves, whereby, they have minimum length, and the three tees 200, 202 and 201 provide branch outlets to which the three ports 28, 21 and 23 are respectively connected. Accordingly, the duct sections 53, 60, 55, 62, and 54 and 61, as well as hoses 203, 204, 204*a* and 205 have minimum length and may consist of low cost tubular plastic material, as shown, facilitating installation, use and repair as required.

Also, the two valves 36 and 56 may then be alike and symmetrically arranged to facilitate ease and simplicity of valve position selection, as via rotatable position selectors (i.e., handles) having clock angles which are alike in their "first," "second" and "third" orientation. Since the valves are alike, and may consist of molded plastic material, cost is minimized. See for example FIG. 1, and the corresponding positions of rotary selectors 36*a* and 56*a*, tabulated as follows:

| Valve Selector | Selector Position | Clock Position |
|---|---|---|
| 56a | OFF | 12 o'clock |
| 36a | OFF | 12 o'clock |
| 56a | 1 | 3 o'clock |
| 36a | 1 | 3 o'clock |
| 56a | 2 | 6 o'clock |
| 36a | 2 | 6 o'clock |
| 56a | 3 | 9 o'clock |
| 36a | 3 | 9 o'clock |

Figure 7:
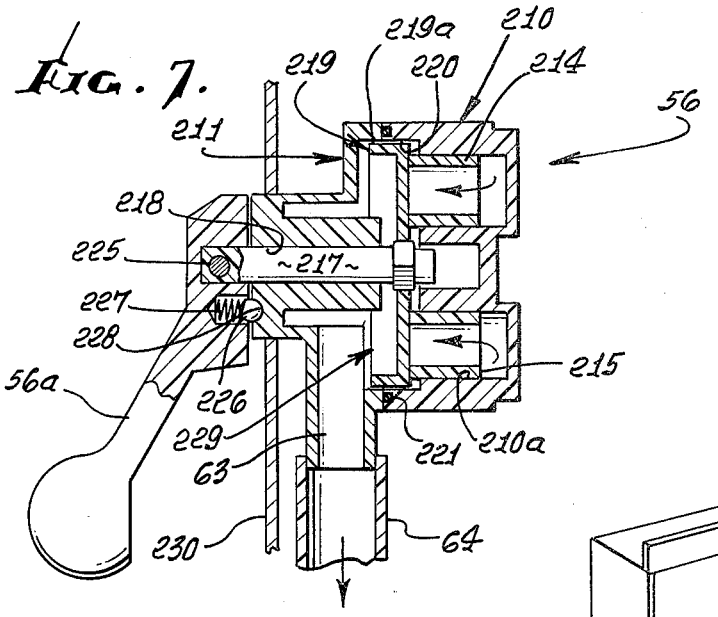
FIG. 7 is a section taken in elevation on lines 7—7 of FIG. 5.
Figures 4, 5, 6:
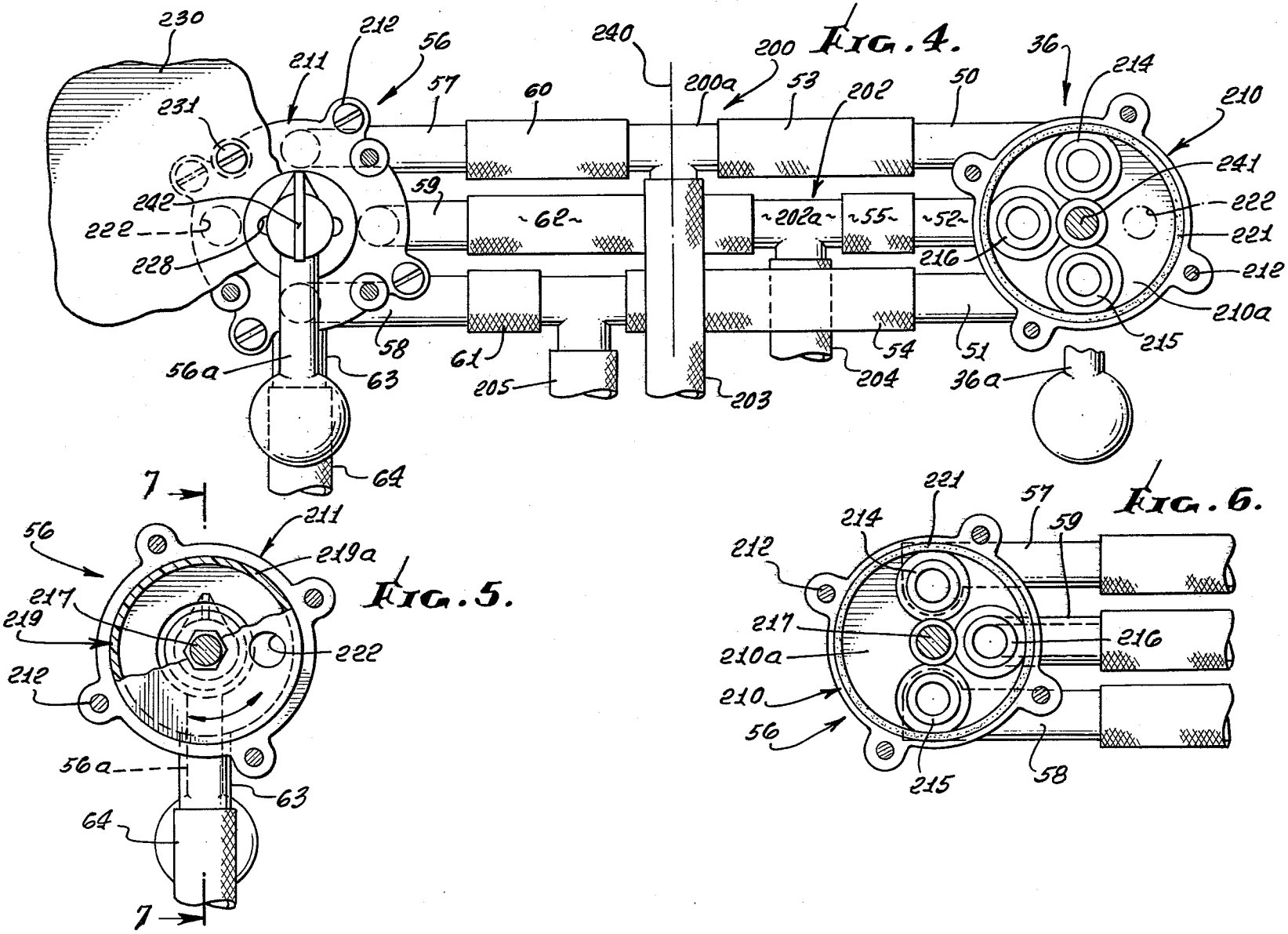
FIG. 4 is an enlarged elevation taken on lines 4—4 of FIG. 3.
FIG. 5 is a section on lines 5—5 of FIG. 3.
FIG. 6 is a section on lines 6—6 of FIG. 3.

The details of one of the two like valves 36 and 56 are shown in FIGS. 3–7. As there illustrated, valve 56 includes a valve body 210 and a cap 211 bolted at 212 to the body. The body contains a chamber 210*a* wherein three separate tubular sleeves 214–216 are located, the sleeves having parallel axes, and respectively communicating with ports 57, 59 and 58. A stem 217, rotatable in bore 218 in the cap carries a disc 219 having an outer annular flange 219*a* rotatable in bore 220. An O-ring seal 221 seals against that flange. As seen in FIG. 7, the ends of sleeves 214–216 seal against the face of disc 219. An opening 222 in the disc 219 is selectively registrable with the sleeves 214–216 as the handle or selector is turned in sequence into the "1," "2" and "3" positions. In FIG. 5, the handle is in OFF position, so that opening 222 is out of registration with the sleeves, i.e., lies opposite the interior 210*a* of the body 210. Handle 56*a* is suitably connected at 225 with the stem 217, and a ball detent 226, spring urged at 227, is carried by the handle to seat in detent openings 228 in the cap at the selected valve handle positions. Water passing through the opening 222 flows via passage 229 to outlet 63 and hose 64. The valve cap is suitably mounted to the console front panel 230, as indicated at 231.

Valve 36 may advantageously have the same construction as valve 56, excepting that the three outlets 50, 52 and 51 of valve 36 and the three inlets 60, 62 and 61 of valve 56 are respectively symmetrically located with respect to a plane parallel to the two spaced, parallel axes of the valve rotors (i.e., stems), that plane bisecting the space between such axes. See plane 240 in FIG. 4, and valve rotor axes 241 and 242 in that view. For simplicity, the cap 221 of valve 36 is rotated 180° relative to the body 210 of that valve, as compared to the positions of these elements in valve 56; also, the handle 56*a* is then rotated 180° relative to the position of the cap.

In operation, the valves 36 and 56 are both turned to "1" position in FIG. 1 and the air selector valve 46 is turned to "1" (FLUSH) position, to supply air to the water inlet flow. As the radiator and water pump are flushed in a reverse direction, the sight glass at 65 may be observed to note flow of scale and other particles toward the drain. After the flow at 65 becomes clear, the valves 36 and 56 are respectively turned to "2" and "3" positions in FIG. 1, whereby the flow is directed reversely through the heater, engine coolant passages, and water pump and the sight glass again observed. After the flow becomes clear, the valves 36 and 56 are located at "3" positions in FIG. 1 whereby the radiator and water pump are flushed in a forward direction, and the sight glass again observed; after the flow becomes clear, the valves 36 and 56 are respectively turned to "1" and "2" positions in FIG. 1, whereby the water pump, engine coolant passages and heater are flushed in a forward direction. Finally, after the flow becomes clear, the valves are toward the OFF position. The hoses 24, 19*b* and 27 are then disconnected, and the hose 19 is connected to the water pump 13 at 19*a*. Hose 25 is reconnected to radiator 12 and the vehicle is then ready for drive away.

Anti-freeze may be added, if required prior to disconnecting hoses 24, 19*b* and 27. To evacuate the system of water, valves 36 and 56 are respectively turned to positions "OFF" and "3." Valve 46 is then turned to drain (position 3) and the air regulator 44 is adjusted to pressurize the system, forcing the water out through hose 19, heater 16, engine block 11, water pump 13, hose 205, valve 56 hoses 64, flow indicator 65 and hose 66 and to drain.

Figure 8:
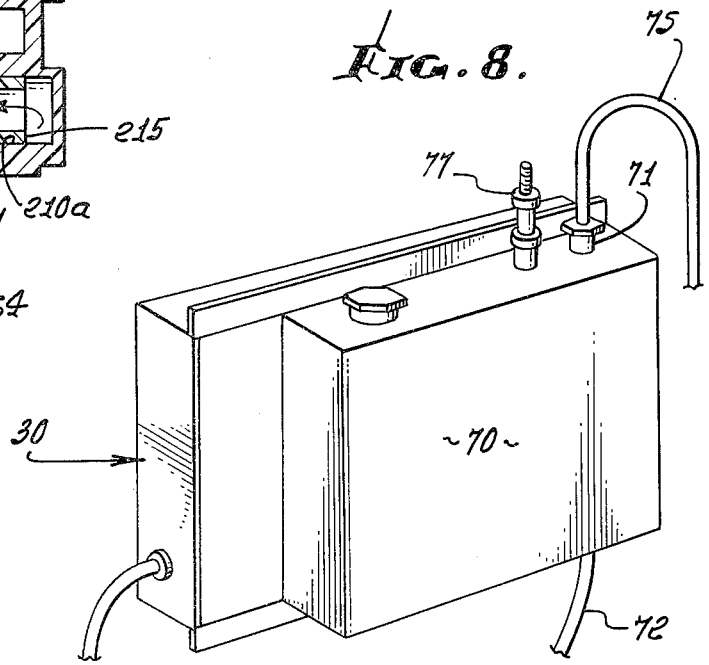
FIG. 8 is a perspective view showing an anti-freeze supply tank associated with the FIG. 1 and FIG. 2 apparatus.

Referring to FIGS. 1*b* and 8, supplied air pressure is employed to displace anti-freeze or coolant into the coolant system. For this purpose, an anti-freeze liquid container 70 may have an inlet 71 selectively connected with air inlet port as via the selector valve 46. The container bottom outlet 72 is connected with the coolant system, as for example by hose 73 connected with hose 19 at point 74, a suitable valve and adapter 74*a* being provided. When the valve 46 is turned to "INJECT" (position 2) as seen in FIG. 1, the air flow in FIG. 1*b* proceeds via line 75 to displace anti-freeze from the tank 70. The liquid flows at 73 and 19 into the system via the heater, displacing water from the heater 16, engine block 10, and radiator 12, through the secondary valve 56 and to the drain. Valve 36 is in OFF position, and valve 56 in position "1" in FIG. 1, at this time. When tank 70 is empty, or the proper amount of anti-freeze has entered the system the valve 74*a* and valve 46 may be returned to OFF position in FIG. 1. A relief valve 77 is installed on the tank to relieve air pressure over about 5 psi.

Tank or container 70 may be mounted at the back side of the console 30, as indicated in FIG. 8. Tank 70 preferably consists of plastic.

Figure 2:
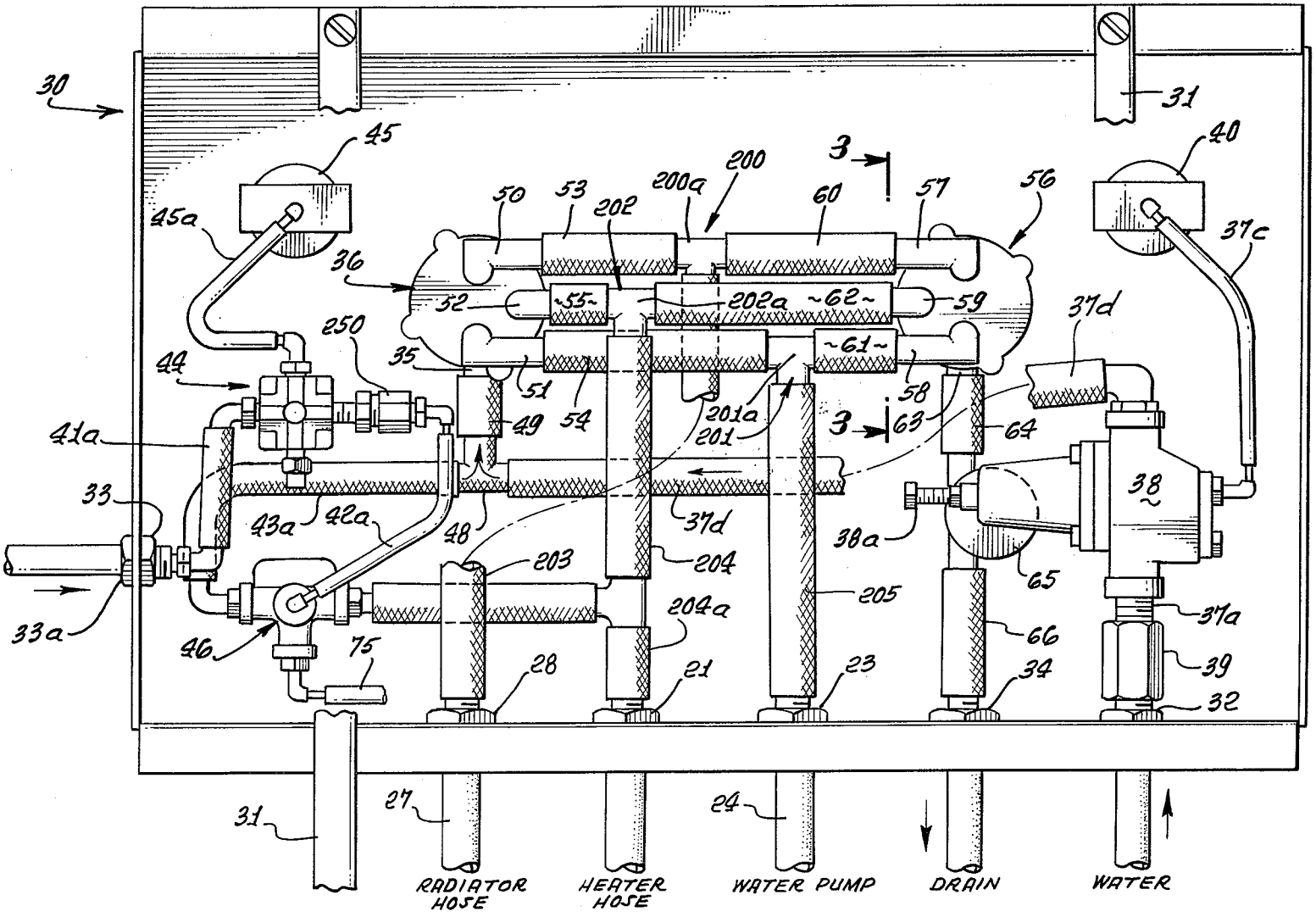
FIG. 2 is a rear view of the FIG. 1 apparatus.
Figure 3:
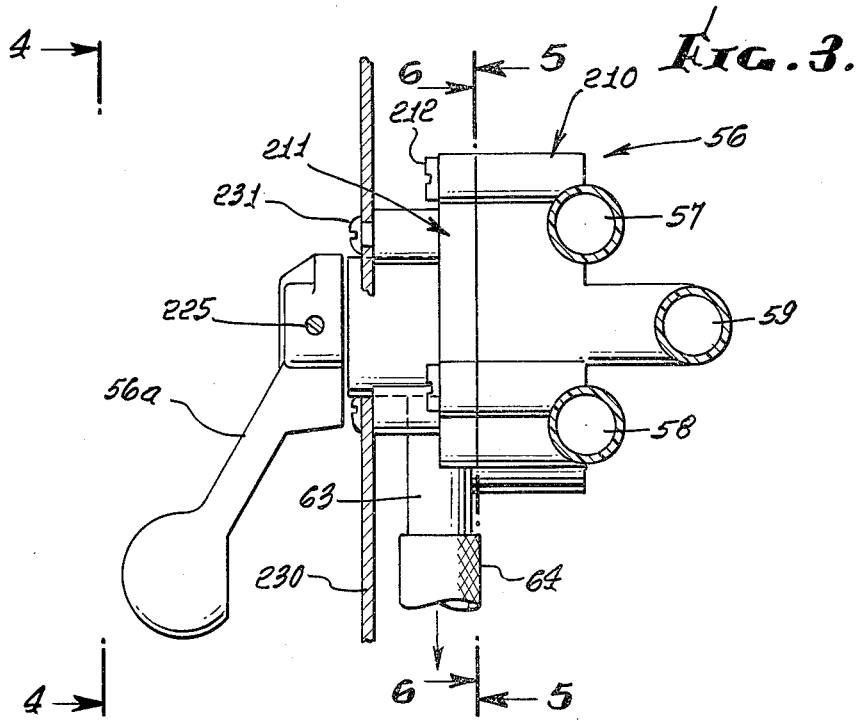
FIG. 3 is an enlarged sectional elevation taken on lines 3—3 of FIG. 2.

Referring back to FIG. 2, a check valve 250 is connected in series with the duct 42*a*, and between regulator 44 and valve 46, to prevent back-flow of water to the regulator 44.

Valves 36 and 56 are produced by Barksdale Control Division, De Laval Turbine Inc., Los Angeles, Calif.

We claim:

1. For combination with an internal combustion engine cooling system that includes a liquid coolant heater, radiator and a liquid coolant pump, flushing apparatus comprising:

a. first means to produce a pressurized flow of flushing liquid and entrained gas bubbles, b. a series of flow ports selectively connectible to different points in said system, utilizing appropriate adaptors, said ports including first, second and third ports, c. control means operable to direct said flow from said first means and via said ports in four separate modes, identified as follows:

i. through the radiator in a reverse direction, ii. through the engine coolant passages in a reverse direction, iii. through the radiator in a forward direction iv. through the engine coolant passages in a forward direction d. said control means including a primary valve connected to receive said flow in the form of pressurized water and air bubbles, said valve having three outlets respectively connectible with said first, second and third ports, e. said series of flow ports including a drain port, and said control means including a secondary valve having three inlets respectively connectible with said first, second and third ports, said secondary valve having a discharge port connectible with the drain port, and f. the three outlets of the primary valve respectively directly communicating with the three inlets of the secondary valve via first, second and third ducts to which said first, second and third ports are respectively connectible.

2. The apparatus of claim 1 including a console carrying said first means, ports and control means.

3. The apparatus of claim 1 wherein said system includes a vehicle heater having a coolant passage connected with an engine coolant passage, and a coolant pump connected with the radiator, said first port selectively connectible to the radiator, said second port selectively connectible with the heater coolant passage, and said third port selectively connectible with the coolant pump.

4. The apparatus of claim 3 including said engine cooling system, and including hoses connecting said first, second and third ports with the radiator, heater and pump, respectively.

5. The apparatus of claim 1 wherein said ducts extend in generally parallel relation directly between said primary and secondary valves.

6. The apparatus of claim 5 wherein said first, second and third ducts have outlets to which said first, second and third ports are respectively connectible.

7. The apparatus of claim 6 wherein said first, second and third ducts consist of plastic tubing, and there being other plastic tubes connecting said duct outlets with said first, second and third ports.

8. The apparatus of claim 1 wherein said valves have manually operable position selectors, each having OFF, first, second and third positions characterized in that:

$i_1$. each selector is in its first positions when said flow is through the radiator in a reverse direction $i_2$. the primary valve selector is in its second position and the secondary valve handle is in its third position when said flow is through the engine coolant passages in the reverse direction, $i_3$. each selector is in its third position when the flow is through the radiator in a forward direction, and $i_4$. the primary valve selector is in its first position and the secondary valve is in its second position when the flow is through the engine coolant passages in a forward direction.

9. The apparatus of claim 8 wherein said selectors are rotatable, and said first, second and third positions of the selectors have like clock angles.

10. The apparatus of claim 9 wherein the valves have selector axes of rotation, said axes being spaced apart and substantially parallel, the three outlets of the primary valve and the three inlets of the secondary valve being respectively symmetrically located with respect to a plane parallel to said axes and bisecting the spacing therebetween.

11. The apparatus of claim 1 wherein said first means includes a pressurized water inlet port, a pressurized air inlet port, and ducting connected between said air and water inlet ports and an inlet port defined by said primary valve.

12. The apparatus of claim 11 wherein said ducting includes water supply ducting, and a water pressure regulator connected in series therewith.

13. The apparatus of claim 12 wherein said ducting includes air supply ducting, and an air pressure regulator connected in series therewith.

14. The apparatus of claim 13 including a check valve connected in series with said air supply ducting and downstream of said air pressure regulator.

15. The apparatus of claim 13 including means to adjust the regulated pressures of said regulators.

16. The apparatus of claim 13 wherein the air selector valve has an alternate position in which the air inlet port is connected directly via one of said ports with said coolant system.

17. The apparatus of claim 1 wherein said first means includes a pressurized water inlet port, and a pressurized air inlet port, and including an anti-freeze liquid container having an inlet selectively connected with said pressurized air inlet port, and an outlet connected with said system.

18. The apparatus of claim 17 including an air selector valve via which the air inlet port is selectively connected with the supply liquid or the anti-freeze liquid container inlet.

19. The apparatus of claim 17 including a console carrying said first means, said ports and said control means, the anti-freeze container attached to said console.

20. The apparatus of claim 1 wherein each of said primary and secondary valves includes:

$x_1$. a housing and three tubular sleeves therein, the sleeves respectively communicating with said inlets or outlets, $x_2$. a disc having sealing relation with said sleeves, the disc having an opening therethrough selectively registrable with said sleeves, the sleeve located at one side of the disc, $x_3$. a selector rotatably mounted to the housing and connected to the disc to rotate said disc for bringing said opening into selective rigistration with said sleeves, $x_4$. the housing having an inflow or outflow port communicating with the opposite side of the disc, in the housing.

21. For combination with an internal combustion engine cooling system that includes a liquid coolant heater, radiator and a liquid coolant pump, flushing apparatus comprising:

a. first means to produce a pressurized flow of flushing liquid and entrained gas bubbles, b. a series of flow ports selectively connectible to different points in said system, utilizing appropriate adaptors, said ports including at least two ports, c. control means operable to direct said flow from said first means and via said ports in four separate modes, identified as follows:

i. through the water pump and radiator in a reverse direction, ii. through the heater, engine coolant passages and water pump in a reverse direction, iii. through the radiator and water pump in a forward direction iv. through the water pump, engine coolant passages and heater in a forward direction d. said control means including a primary valve connected to receive said flow in the form of pressurized water and air bubbles, said valve having multiple outlets respectively connectible with said ports, e. said series of flow ports including a drain port, and said control means including a secondary valve having multiple inlets respectively connectible with said ports, said secondary valve having a discharge port connectible with the drain port, and f. the outlets of the primary valve respectively directly communicating with the inlets of the secondary valve via multiple ducts to which said ports are respectively connectible.

* * * * *